US006919851B2

(12) United States Patent
Rogers et al.

(10) Patent No.: US 6,919,851 B2
(45) Date of Patent: Jul. 19, 2005

(54) BROADBAND MONOPOLE/ DIPOLE ANTENNA WITH PARALLEL INDUCTOR-RESISTOR LOAD CIRCUITS AND MATCHING NETWORKS

(75) Inventors: Shawn D. Rogers, Jessup, MD (US); Chalmers M. Butler, Clemson, SC (US); Anthony Q. Martin, Greenville, SC (US)

(73) Assignee: Clemson University, Clemson, SC (US)

( * ) Notice: Subject to any disclaimer, the term of this patent is extended or adjusted under 35 U.S.C. 154(b) by 18 days.

(21) Appl. No.: 10/207,665

(22) Filed: Jul. 29, 2002

(65) Prior Publication Data

US 2003/0103011 A1 Jun. 5, 2003

Related U.S. Application Data

(60) Provisional application No. 60/308,697, filed on Jul. 30, 2001.

(51) Int. Cl.[7] ..... H01Q 9/16

(52) U.S. Cl. ..... 343/749; 343/822; 343/860

(58) Field of Search ..... 343/749, 750, 343/722, 820–822, 850, 860

(56) References Cited

U.S. PATENT DOCUMENTS

| | | | |
|---|---|---|---|
| 4,328,501 | A | 5/1982 | DeSantis et al. |
| 5,600,335 | A | 2/1997 | Abramo |
| 5,734,352 | A | 3/1998 | Seward et al. |

OTHER PUBLICATIONS

PCT International Search Report, International Application No. PCT/US02/23998, date of completion of International Search Sep. 26, 2002, date of mailing of International Search Report Dec. 18, 2002. The three U.S. Patents cited in International Search Report listed above.

K. Yegin and A. Q. Martin, "Very Broadband Loaded Monopole Antennas," *IEEE AP–S International Symposium Digest*, vol. 1, pp. 232–235, Jul. 1997, Montreal, Canada.

D. L. Carroll, "Chemical Laser Modeling with Genetic Algorithms," *AIAA Journal*, vol. 34, No. 2, pp. 338–346, Feb. 1996.

Alona Boag, Amir Boag, Eric Michielssen and Raj Mittra, "Design of Electrically Loaded Wire Antennas Using Genetic Algorithms," *IEEE Transactions on Antenna Propagation*, vol. AP–45, pp. 1494–1501, Oct. 1997.

Zwi Altman, Raj Mittra and Alona Boag, "New Designs of Ultra Wide–Band Communication Antennas Using a Genetic Algorithm," *IEEE Transactions on Antennas and Propagation*, vol. 45, No. 10, Oct. 1997.

Shawn D. Rogers, John C. Young and Chalmers M. Butler, "Computational Models For Practical Antenna Loads," Department of Electrical and Computer Engineering, Clemson University, Clemson, SC, *IEEE*, 0–7803–6369, Aug. 2000.

*Primary Examiner*—Michael C. Wimer
(74) *Attorney, Agent, or Firm*—Dority & Manning, P.A.

(57) ABSTRACT

A broadband loaded antenna and matching network with related methods for design optimization are disclosed. The loaded antenna structures may preferably be either monopole or dipole antennas, but the particular methods and techniques presented herein may be applied to additional antenna configurations. The load circuits positioned along an antenna may comprise parallel inductor-resistor configurations or other combinations of passive circuit elements. A matching network for connecting an antenna to a transmission line or other medium preferably includes at least a transmission line transformer and a parallel inductor. Various optimization techniques are presented to optimize the design of such broadband monopole antennas. These techniques include implementation of simple genetic algorithms (GAs) or micro-GAs. Component modeling for selected components may be effected through either lumped element representation or curved wire representation. Measured results are presented to ensure that certain design criteria are met, including low voltage standing wave ratio (VSWR) and high gain over a desired frequency band.

37 Claims, 13 Drawing Sheets

BROADBAND MONOPOLE/ DIPOLE ANTENNA WITH PARALLEL INDUCTOR-RESISTOR LOAD CIRCUITS AND MATCHING NETWORKS

PRIORITY CLAIM

This application claims the benefit of previously filed U. S. Provisional Patent Application with the same inventors and title as present, assigned U.S. Ser. No. 60/308,697, filed Jul. 30, 2001, and which is incorporated herein by reference for all purposes.

FEDERAL FUNDING

Work was funded in part by the Department of Defense (DoD) through grants DAAH04-1-0247 and DAAG55-98-1-0009.

BACKGROUND OF THE INVENTION

The present subject matter generally concerns a broadband antenna with load circuits and matching network, and more particularly concerns a broadband monopole antenna with parallel inductor—resistor load circuits. The subject loaded antenna design may be optimized by various tools including a genetic algorithm and integral equation solver.

Wire antennas have been used in countless communications applications, and often require the ability to provide omnidirectional capabilities over a wide range of frequencies. Many basic antenna configurations exist that radiate in azimuth with omnidirectional capabilities, such as a wire monopole antenna or dipole antenna. However, these types of antennas are typically characterized as narrowband. In order to increase the bandwidth of such antennas, load circuits can be added at regular intervals along a general wire antenna segment. Such load circuits may comprise a selected combination of passive elements, including resistors, inductors and/or capacitors.

Another potential method for increasing the bandwidth of monopole or dipole antennas is to include a matching network at the base of the antenna where it is driven to the ground plane. Such a matching network ideally matches the impedance of an antenna to that of the transmission line or other medium to which it is connected. Numerical results for a loaded monopole antenna having a matching network are presented by K. Yegin and A. Q. Martin in "Very broadboand loaded monopole antennas," *IEEE AP-S International Symposium Digest*, vol. 1, pp. 232–235, July 1997, Montreal Canada.

Given a general antenna configuration, various methods are known that can optimize specific parameters corresponding to the configuration. For instance, parameters corresponding to a loaded monopole antenna may include the values of passive elements used in the load circuits, the position of load circuits along an antenna arm, and the values of elements used in matching networks. There are several tools known in the field of antenna design that are available for optimizing such parameters. These tools include genetic algorithms and integral equation solvers.

Genetic algorithms (GAs) are robust search and optimization routines which simulate the theory of evolution on a computer in order to maximize or minimize a user-defined objective function. An initial set of candidate antenna configurations are presented and evaluated in terms of an objective function. Better antenna configurations are allowed to reproduce into further generations of additional antenna configurations. The generation process may typically account for crossover between generations or mutations to randomly selected designs. A GA typically performs multiple iterations of this generation process to yield a set of antenna configurations with optimal solutions to the defined objective function. An example of the type of genetic algorithm used is embodied by a FORTRAN program developed by David Carroll, details of which are presented by D. L. Carroll in "Chemical Laser Modeling with Genetic Algorithms," *AIAA Journal*, vol. 34, no. 2, pp. 338–346, February 1996.

Genetic algorithms and the numerical equations incorporated therein to model loaded antenna configurations typically model the load circuits as lumped elements concentrated at a node. This may not be the best way to model a load circuit, especially if the load circuit comprises passive elements that have a larger diameter than the antenna arm to which the load circuits are added. An example of genetic algorithms with lump load modeling used to design optimum antenna configurations is presented by Alona Bag et al. in "Design of Electrically loaded wire antennas using genetic algorithms," *IEEE Transactions on Antenna Propagation*, vol. AP-45, pp. 1494–1501, October 1997. Only theoretical configurations and numerical results are presented.

It is desired to readily construct such a loaded monopole antenna that works well over a broad range of frequencies. Such a configuration could potentially replace several antennas that operate in different frequency bands. A single functioning loaded monopole is desired for applications requiring such broadband operation, such as in conjunction with basestations or vehicles in a mobile communication network. The construction and realization of such loaded monopole/dipole antennas with matching networks is thus desired.

The disclosures of all of the foregoing technical references and journal articles are hereby fully incorporated for all purposes into this application by reference thereto.

BRIEF SUMMARY OF THE INVENTION

In view of the discussed drawbacks and shortcomings encountered in the prior art, an improved broadband monopole/dipole antenna has been developed. Thus, broadly speaking, a general object of the present subject matter is improved design of parallel inductor-resistor load circuits and matching networks for a broadband monopole or dipole antenna.

It is a principal object of the presently disclosed technology to provide a broadband loaded antenna design that is characterized by omnidirectional radiation in azimuth and also by operation over a wider frequency band.

It is another principal object of the disclosed technology to provide a matching network for connection to a loaded antenna for further increasing the antenna's bandwidth capabilities.

It is further object of the present subject matter to enable the incorporation of various optimization tools to design parameter values for the broadband loaded antenna of the present subject matter.

It is an additional object of the present subject matter to utilize circuit configurations for load circuits and matching networks that are simple, efficient, and easily constructed.

Additional objects and advantages of the presently disclosed technology are set forth in, or will be apparent to those of ordinary skill in the art from, the detailed description herein. Also, it should be further appreciated that modifications and variations to the specifically illustrated, referred and discussed features and steps hereof may be practiced in various embodiments and uses of this technology without departing from the spirit and scope thereof, by virtue of present reference thereto. Such variations may include, but are not limited to, substitution of equivalent means and features for those illustrated, referenced or discussed, and the functional, operational or positional reversal of various parts, features, steps or the like.

Still further, it is to be understood that different embodiments, as well as different presently preferred embodiments, of this subject matter may include various combinations or configurations of presently disclosed features or elements, or their equivalents (including combinations of steps, features or parts or configurations thereof not expressly shown in the figures or stated in the detailed description). One exemplary such embodiment of the present subject matter relates to loaded broadband antenna for operation in a wide frequency band and for providing omnidirectional radiation in azimuth. Such loaded antenna preferably comprises at least one straight antenna arm and at least one load circuit positioned along the antenna arm. The antenna could be a monopole or dipole antenna, and the load circuit preferably comprises a parallel inductor-resistor network. A matching network is preferably provided to interface the antenna to a transmission line and may comprise a Guanella 1:4 transformer and parallel inductance. Various parameters of the configuration may be designed using optimization techniques including a genetic algorithm. Specific materials for readily constructing such an embodiment are also presented.

Another exemplary embodiment of the disclosed technology relates to a loaded broadband antenna with multiple load ciruits. The load circuits may preferably comprise either a parallel inductor-resistor network or an inductor network without a parallel resistor. A matching network is preferably provided to interface the antenna to a transmission line and may comprise at least an impedance transformer and may also include a parallel inductor in other embodiments of the matching network. Components may be designed by utilizing various optimization tools including genetic algorithms and integral equation techniques. Specific materials for readily constructing such an embodiment are also presented.

Yet another exemplary embodiment of the present subject matter concerns a matching network for connecting an antenna to a transmission line to increase the operational bandwidth of the antenna. Such a matching network preferably comprises a transmission line transformer in parallel with a selected passive circuit element. Such passive circuit element may be an inductor, and no additional passive circuit elements are needed in the matching network. This simplified matching network provides sufficient functionality but with reduced component part compared to more complicated alternative matching networks. The transmission line transformer may be a Guanella 1:4 unun, such as formed either by providing a plurality of multifilar windings on a ferrite toroidal core or by positioning a plurality of ferrite toroidal cores around the outer conductor or a coaxial cable segment.

A still further exemplary embodiment of the present subject matter concerns a micro-GA based method of designing a loaded broadband antenna configuration with circuit values and locations for load circuits positioned along the antenna and for a matching network. A first exemplary step of such method involves establishing a set of design criteria for various circuit values, load positions, and/or antenna performance criteria. A second step involves creating an initial antenna population with given size N. An objective function is then evaluated for every member in the antenna population. A selected number of successive antenna generations are then formed, wherein the established objective function is evaluated for each member in the successive antenna generations. After the selected number of successive generations have been formed, an elite generation is formed by picking the best member of the previous generation and a number of others at random. The number of antennas chosen at random corresponds to a number M, where M may preferably be equal to N−1. A final step is to determine if the established set of design criteria is met. If the design criteria are met, then the optimization process is complete. If not, then the process is successively iterated until the design criteria are met.

Additional embodiments of the present subject matter, not necessarily expressed in this summarized section, may include and incorporate various combinations of aspects of features, parts or steps referenced in the summarized objections above, and/or other features or parts as otherwise discussed in this application.

It is to be understood that the present subject matter likewise encompasses the use of methodologies and techniques which correspond with practice of the physical apparatuses and devices otherwise disclosed herein.

Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures in showing respectively various aspects of the present subject matter, in which:

FIG. 2*a* illustrates an exemplary loaded folded monopole antenna; FIG. 2*b* illustrates an exemplary loaded twin whip antenna; FIG. 2*c* displays an exemplary loaded kite antenna and FIG. 2*d* illustrates an exemplary loaded vase antenna;

Figure 1A:
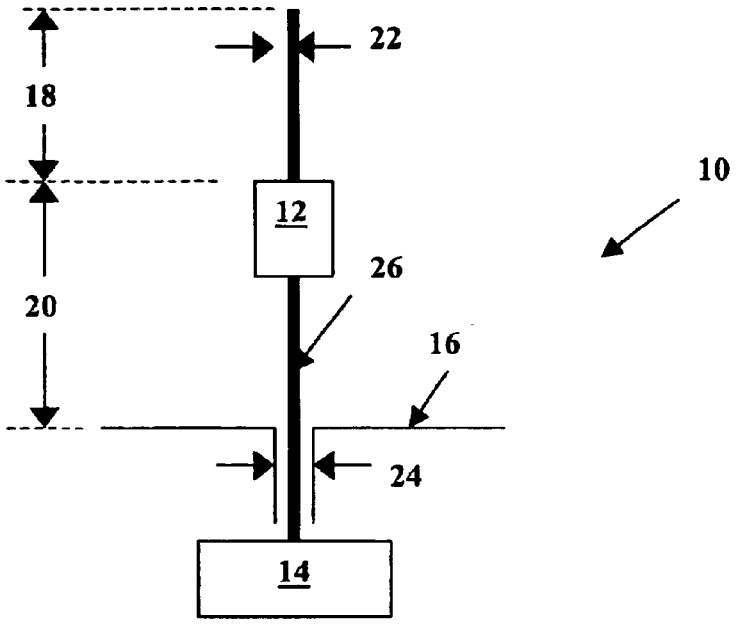
FIG. 1*a* illustrates a first exemplary monopole antenna configuration with a single load circuit and matching network in accordance with the present subject matter.

Repeat use of reference characters throughout the present specification and appended drawings is intended to represent same or analogous features or elements of the disclosed technology.

DETAILED DESCRIPTION OF PREFERRED EMBODIMENTS

As discussed in the Brief Summary of the Invention, supra, the present subject matter is particularly concerned with improved broadband antenna designs that incorporate load circuits and matching networks. Several varied embodiments of such a broadband antenna configuration are presented along with optional configurations of exemplary load circuits and matching networks for use in conjunction with the antenna configurations. There are several variables that play a role in the overall performance of a loaded antenna configuration, including component values and relative position of such components among the loaded antenna configuration.

The design variables of the subject loaded antenna configurations may be optimized via a genetic algorithm (GA), details of which are presented in accordance with the present subject matter. Incorporation of various other numerical techniques is ideal for inclusion with a general genetic algorithm. Such techniques include integral equation solution techniques and the adaptation of a micro-GA as opposed to a simple-GA.

The design and implementation of practical antenna loads is presented. More particular details relating to methods of construction are presented for exemplary embodiments of the subject antenna technology. Experimental results and measurements are presented to verify certain antenna performance characteristics and to display differences between measured results and computed predictions for the subject antenna designs.

Figure 1B:
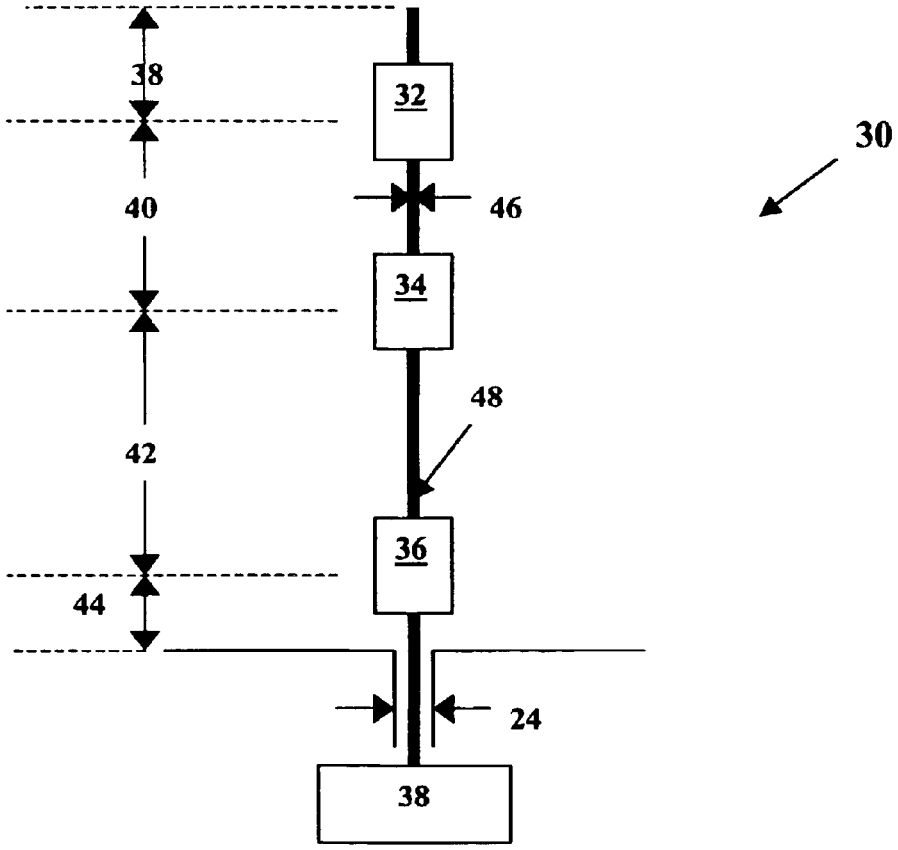
FIG. 1*b* illustrates a second exemplary monopole antenna configuration with three load circuits and matching network in accordance with the present subject matter.

Many antenna configurations are known to provide omnidirectional radiation capabilities. Such antenna configurations include monopole, dipole, kite, diamond or other configuration. Each potential configuration comprises a predefined number of generally straight wire antenna segments that branch from a central stem. These straight wire segments of a basic antenna configuration are often loaded with lumped circuits, or load circuits, in order to increase the bandwidth of antenna operation. FIGS. 1*a* and 1*b* illustrate exemplary loaded monopole antenna configurations that may be employed in accordance with the present subject matter. The monopole antenna 10 of FIG. 1*a* has a single load circuit 12 positioned along the single antenna arm 26. The monopole antenna 30 of FIG. 1*b* has three loading circuits 32, 34 and 36, arranged at intervals along its single straight wire antenna arm 48. Matching network 14 of FIG. 1*a* is arranged between antenna arm 26 and the transmission line to which the antenna may be connected. This matching network is located below the ground reference plane 16 and may typically comprise a transmission line transformer. It should be appreciated in accordance with this and other exemplary embodiments of the present technology that matching networks may be connected to an antenna either above or below a ground reference plane.

The configurations of FIGS. 1*a* and 1*b* employ a single antenna arm with load components. Load components and matching networks can be combined with antenna arms in other ways to provide additional embodiments of a loaded broadband antenna with matching network per the present subject matter.

FIGS. 2*a*, 2*b*, 2*c* and 2*d*, hereafter collectively referred to as FIG. 2, depict additional antenna configurations that may be employed in accordance with the present antenna technology.

Figure 2A:
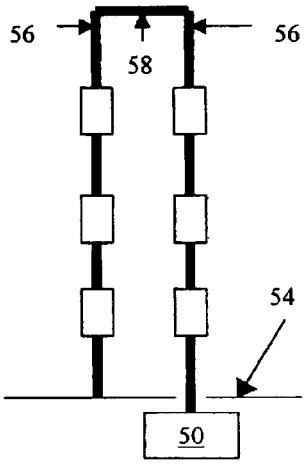
FIGS. 2*a* through 2*d* display additional exemplary loaded antenna configurations for use in accordance with the subject antenna construction.

More particularly, FIG. 2*a* illustrates an exemplary folded monopole antenna configuration with two loaded arm segments 56 and a matching network 50. Matching network 50 is connected to a selected arm 56 below ground reference plane 54. The ends of antenna arm segments 56 not driven at the ground plane may preferably be jointly connected by an unloaded straight wire segment 58.

Figure 2B:
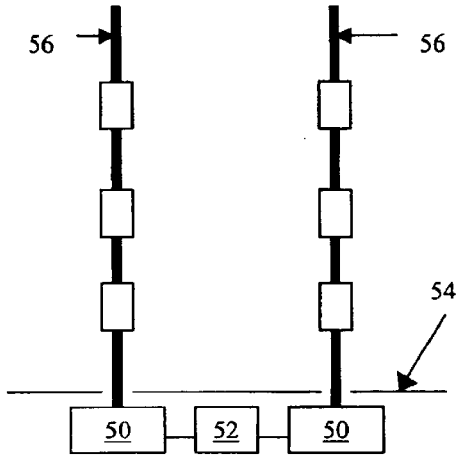

FIG. 2*b* displays an exemplary twin whip antenna configuration, consisting of two loaded arm segments 56 and two matching networks 50. A power divider 52 may typically be utilized so that each whip 56 is properly excited at the base.

Figure 2C:
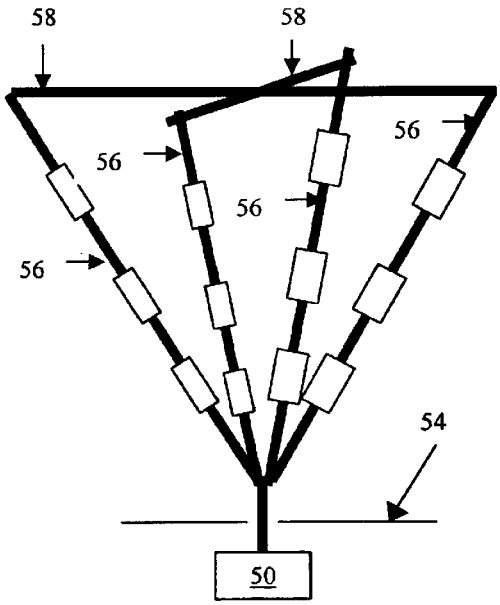
Figure 2D:
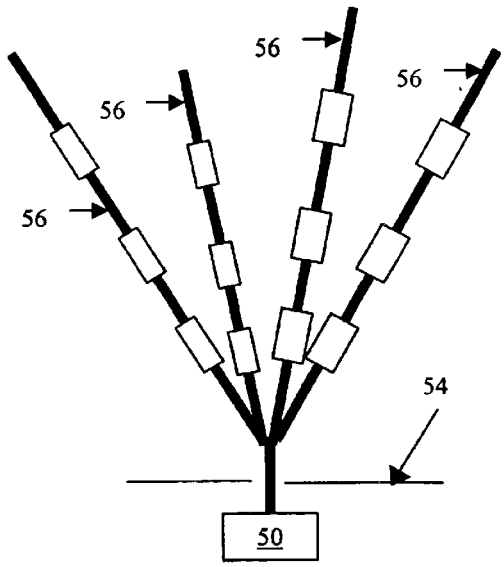

FIGS. 2*c* and 2*d* display an exemplary loaded kite antenna configuration and loaded vase antenna configuration, respectively. A loaded kite antenna configuration may comprise any number of arm segments 56. Four arm segments are depicted in FIG. 2*c*, each angled outwardly from a central stem that connects to a matching network 50 below the ground plane 54. Opposing arms 56 are connected by straight wire segments 58. If the straight wire segments 58 are removed from the kite antenna configuration of FIG. 2*c*, then the vase antenna configuration of FIG. 2*d* is effected. The multi-arm configurations of FIG. 2*c* and 2*d* tend to be characterized by both high antenna gain and low voltage standing wave ratio (VSWR).

Particular embodiments of the present specification will be discussed with reference to a loaded monopole antenna, but the details presented can also be readily applied to dipole antennas, the configurations of FIG. 2, and other antenna configurations. Similar arm segments, loading circuits and matching networks may correspondingly be rearranged in accordance with a specified basic antenna configuration, as understood by those of ordinary skill in the art.

Figure 3A:
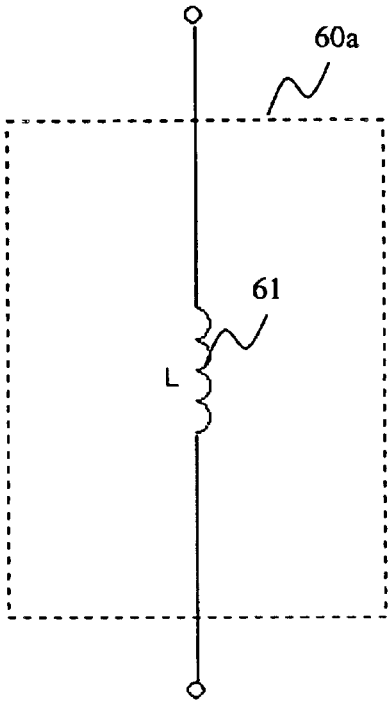
FIGS. 3*a*, 3*b*, 3*c* and 3*d* display exemplary load circuits comprising selected passive elements for use in loaded antenna configurations in accordance with the present subject matter.
Figure 3B:
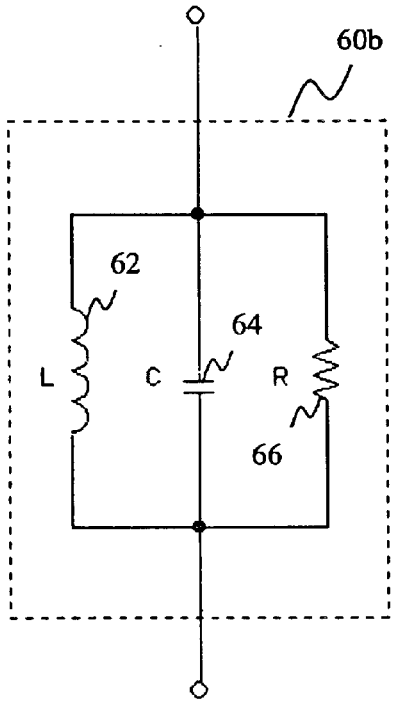
Figure 3C:
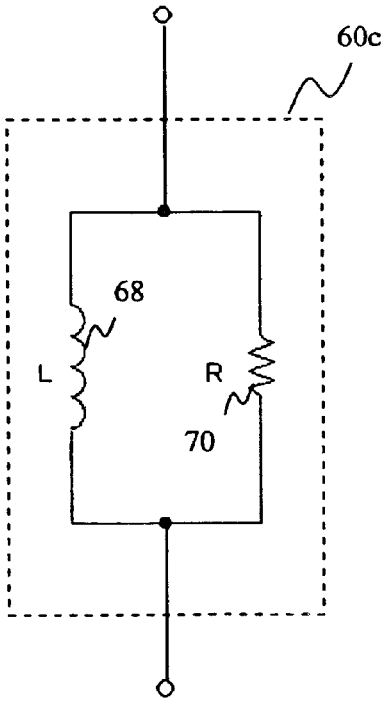
Figure 3D:
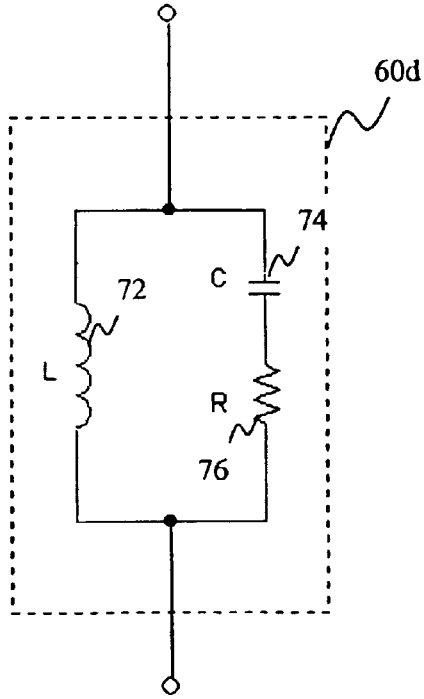

Load circuits are often added at regular intervals along an antenna arm to improve the bandwidth of the antenna. Such load circuits, also referred to as lumped loading circuits, typically include either inductors and/or capacitors in their individual circuit configuration. Several illustrations of exemplary component configurations for a loading circuit that may be incorporated into various present embodiments are displayed in FIGS. 3*a*, 3*b*, 3*c* and 3*d*, hereafter collectively referred to as FIG. 3. The loading circuit 60*a* of FIG. 3*a* consists of a single inductor 61. FIG. 3*b* displays a loading circuit 60*b* with an inductor 62, a resistor 66 and a capacitor 64 all in parallel. FIG. 3*c* displays an exemplary inductor 68 and resistor 70 in parallel as an exemplary load circuit 60*c*. The loading circuit 60*d* of FIG. 3*d* comprises a series resistor 76 and capacitor 74 in parallel with an inductor 72. These and other load circuits may be added along an antenna arm to increase antenna performance, and the circuits of FIG. 3 are presented as exemplary configurations for incorporation into present exemplary embodiments.

In accordance with the present subject matter, matching networks may also be connected to a straight wire antenna configuration such as those in FIGS. 1*a*, 1*b* and 2. Such matching networks are typically connected to the antenna below a ground reference plane, but may also be connected above such ground plane. The matching network typically connects the antenna to the transmission line or other medium to which it is connected. A typical element of a matching network is a transmission line transformer, and often various passive circuit elements are included as well. Schematic representations of exemplary matching networks for use in conjunction with a loaded antenna per present exemplary embodiments are displayed in FIG. 4*a*, FIG. 4*b* and FIG. 4*c*, hereafter collectively referred to as FIG. 4.

The passive circuit elements included in these exemplary configurations are inductors and capacitors, but may also include resistors in other matching network configurations. The matching network 80*a* of FIG. 4*a* includes a transmission line transformer 84 in parallel with a single inductor 82. The matching network 80*b* of FIG. 4*b* includes a transmission line transformer 92 in parallel with an inductor 90 and a capacitor 88. Another inductor 86 is provided at the connection of matching network 80*b* to an antenna configuration. The matching network 80*c* of FIG. 4*c* includes a transmission line transformer 104 in parallel with a first inductor 94, a second inductor 96 and a third inductor 98. A first capacitor 100 is provided between parallel inductors 94 and 96, and a second capacitor 102 is provided between parallel inductors 96 and 98.

The position of load circuits along an antenna arm may ideally be determined by means of a genetic algorithm (GA) optimizer. Such an optimizer has the ability to design antenna configurations so that the bandwidth of antenna operation is maximized. Measurements are taken to ensure that the antenna configuration is characterized by high gain and low voltage standing wave ratio (VSWR). Other measurement characteristics beyond VSWR and gain may be evaluated to ensure ideal antenna operation. The use of a GA to design a loaded broadband antenna with matching network is typically used in conjunction with additional analytical tools to provide a preferred design application. Such analytical tools may include integral equation solution techniques, inductance computations, and matching network characterization via measured s-parameters.

Design variables to optimize for a loaded antenna configuration include the values and positions of load circuits and matching networks. During a design optimization process using a genetic algorithm, the objective function must be evaluated for each member of an antenna population. This evaluation requires the analysis of a general metallic structure with different load circuits and matching networks to be evaluated. Evaluation of wire antennas incorporates the method of moments which requires computation and inversion of large matrices. This evaluation process is computationally expensive and time-consuming. Thus, the genetic algorithm for use in the subject process ideally computes and inverts the method of moments matrices only once for an unloaded antenna design. Additional calculations account for the values and positions of the load circuits and matching networks. More particularly, the inverse of an impedance matrix is stored for every frequency of interest so that existing techniques referred to as Sherman-Morrisson-Woodbury formulation can be employed to evaluate many potential loads and matching networks. Other existing fast, loaded-antenna analysis algorithms have been utilized in accordance with such evaluation and may alternatively be used in accordance with the subject antenna optimization process.

Another reason that genetic algorithms can be applied to antenna design in a fast and efficient manner per the present subject matter is that load circuits are analyzed as lumped-load elements concentrated at a particular point along an antenna arm. This may be practical for modeling a resistor, but not for modeling the coiled inductor elements often contained in typical load circuits, especially if the coil is much larger than the antenna arm. Modeling the wire in the helical part of a wire antenna in a curved-wire solution procedure is less efficient than using a lumped-load model that typical genetic algorithms may employ. This decrease in efficiency relates to the fact that every potential configuration requires geometry definition and matrix fill and solve time. However, once the design is established and achieved in accordance with a genetic algorithm, curved-wire techniques may be used per the present subject matter for an improved prediction of the coil-loaded antenna's performance.

To illustrate the differences in the two modeling techniques, results are presented for both lumped load analysis and curved wire analysis for a given antenna configuration. The antenna configuration corresponding to the measurements is that of FIG. 1*a*. For the analysis, the distance 18 between the end of the antenna arm and load circuit 12 is 9 cm. Distance 20 between load circuit 12 and ground plane 16 is 11.25 cm. Load circuit 12 comprises a parallel resistor-inductor network similar to that of FIG. 3*c* with a resistor value of 470Ω. Five coils form the inductive element such that it has a length along the antenna of about 1 cm and a diameter of about 1.33 cm. The matching network is ideally similar to that of FIG. 4*a* with a 1:4 impedance transformer and an inductor value of 0.4 $\mu$H.

Figure 6A:
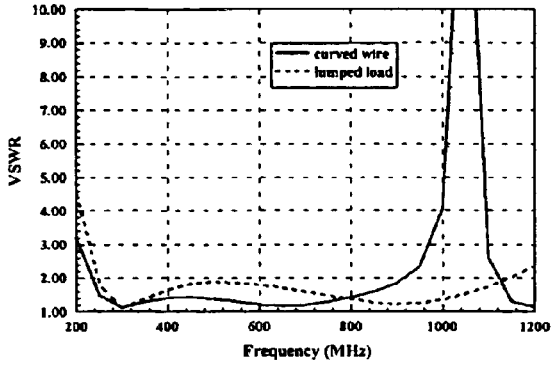
FIGS. 6*a*, 6*b* and 6*c* are graphical data representing various measurements for antenna configurations modeled in accordance with present subject matter using lumped load component representation versus curved wire component representation.
Figure 6B:
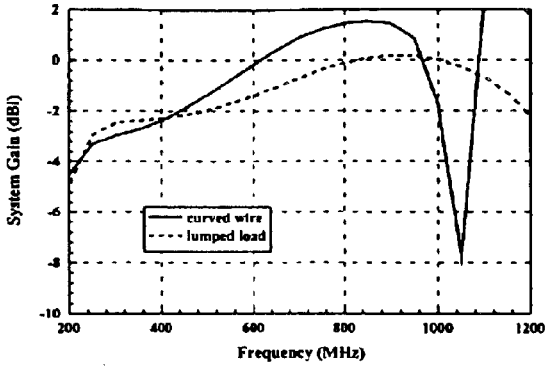
Figure 6C:
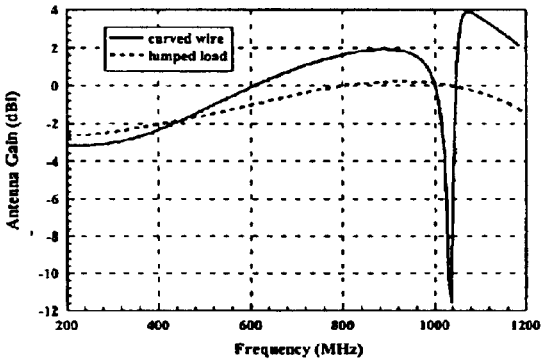

FIGS. 6*a*, 6*b* and 6*c* illustrate the broadband response of the loaded antenna with matching network using both a curved-wire model and a lumped load model of the antenna coil. FIG. 6*a* illustrates the voltage standing wave ratio (VSWR), FIG. 6*b* displays the computed system gain, and FIG. 6*c* shows the antenna gain over a range of frequencies. The calculated data indicate that the bandwidth of the system is less than that predicted for an ideal parallel LR lumped load. The antenna with the five-turn coil has high VSWR in the vicinity of 1 GHz, whereas the system with the ideal load does not.

There are a number of design goals that can be specified in accordance with the genetic algorithm of the present subject matter. Many times it is desired that the element to be optimized either falls within a given range or has a given resolution. It is possible to input desired amounts for given parameters and others. A sample of possible values for the components of an antenna configuration with single parallel LR load circuit and matching network with a transformer and parallel inductor in accordance with present subject matter is provided in the table below, Table 1.

TABLE 1

| | Exemplary parameter ranges for GA optimization | | | | |
|---|---|---|---|---|---|
| | MIN | MAX | # BITS | # POSSIBILITIES | RESOLUTION |
| LOAD (L) | 0.02 μH | 0.30 μH | 6 | 64 | 0.0044 μH |
| LOAD (R) | 100 Ω | 2500 Ω | 11 | 2048 | 1.17 Ω |
| MATCHING NETW. (L) | 0.4 μH | 1.0 μH | 4 | 16 | 0.04 μH |
| LOAD POSITION | 0.16 cm | 21.08 cm | 7 | 128 | 0.165 cm |

Various other parameters can also be defined for a genetic algorithm to specify more about the type of evolution that occurs among configurations in a given antenna population. Such parameters per the present subject matter may include elitism, niching, uniform crossover probability, jump mutation probability, and number of children per pair of parents.

Other specifications for the design process may be expressed as related to ideal antenna operation. Ideal operation can be defined in terms of bandwidth, efficiency, gain and/or voltage standing wave ratio (VSWR), each parameter of which may be incorporated into the objective function to be optimized via the genetic algorithm per the present subject matter. Assume that the goal of optimization for a specific application is to generate a loaded monopole antenna with voltage atanding wave ratio (VSWR) less than 3.5 and a system gain at the horizon greater than −2.0 dBi over a wide band of frequencies. System gain in this particular sense is defined as the power radiated into the far field in a specified direction to the power available from the generator and is expressed as $$G_{sys}=10\log_{10}\{(1-|\Gamma|^2)M_{eff}G_A(\theta=90°)\}dBi,$$

where Γ is the reflection coefficient at the input to the matching network system, $M_{eff}$ is the matching network efficiency, and $G_A$ is the antenna gain. An exemplary objective function for use in accordance with a desired VSWR and system gain at the horizon for each of the $N^f$ frequencies in a given band of interest is given by $$F=-\sum_{i=1}^{N^f}\{u(VSWR(f_i),\ VSWR^D(f_i))+u(G_{sys}^D(f_i),\ G_{sys}(f_i))\}$$

$$\text{where}\quad u(x,y)=\begin{cases}|x-y|^2, & x>y\\ 0, & \text{otherwise}\end{cases}.$$

In the above formula, the desired VSWR is denoted $VSWR^D$ and the minimum desired system gain is $$G_{sys}^D.$$

The exemplary desired values previously referenced would correspond to $VSWR^D$=3.5 and $$G_{sys}^D=-2.0\ dBi.$$

The genetic algorithm employed to generate an optimum antenna design per the present subject matter ideally would maximize the objective function (F). If design goals are not met for some frequencies $f_i$, the objective function F is negative. If the system meets or exceeds the design goals for every frequency of interest, then F has value zero. It is apparent to those of ordinary skill in the art that the given objective function F as presented cannot exceed zero. This objective formula could very well be presented in such a manner that F could take on positive values. The potential range of values for F merely depends on how F is defined.

Genetic algorithms (GAs) used in accordance with the subject technology may be either a conventional GA (simple GA) or a micro-GA. Both types were analyzed in accordance with the optimization process of the present subject matter to evaluate the efficiency of the GA. The GAs are applied to a loaded antenna configuration and matching network such as that illustrated in FIG. 1*b*. Load circuits 32 and 34 were parallel LR circuits such as those displayed in FIG. 3*c* and load circuit 36 was an inductor circuit such as that of FIG. 3*a*. A matching network is specified to be one such as that illustrated in FIG. 4*a*. Thus, there are four inductance values and two resistance values to be optimized by the various GA forms. The transformer impedance ratio and the positions of the loads were not considered optimization parameters for the analysis. The ranges and resolution of each of the six parameters are listed below in Table 2.

TABLE 2

| | Parameter ranges for GA optimization | | | | |
|---|---|---|---|---|---|
| | MIN | MAX | # BITS | # POSSIBILITIES | RESOLUTION |
| LOAD (L) | 0.01 μH | 1.1 μH | 8 | 256 | 0.0043 μH |
| LOAD (R) | 100 Ω | 2500 Ω | 11 | 2048 | 1.17 Ω |
| MATCHING NETW. (L) | 0.01 μH | 0.8 μH | 8 | 256 | 0.0031 μH |

The binary bit string used to represent all of the parameters is referred to as a chromosome. There are 54 bits in the chromosome used to represent the six parameters in the loaded antenna and matching network system. Thus, there are 1.8e16 ($2^{54}$) total choices in the discretized parameter space.

A simple GA that implements binary tournament selection is used. In this analysis, elitism, niching and crossover mutation are enabled. Table 3 shows the number of objective function evaluations which results for various choices of the antenna population size and mutation probabilities per present subject matter used in the comparison.

TABLE 3

GA Settings and resulting number of objective function evaluations (uniform crossover with probability 0.5, random seed number -1000)

| GA Case # | GA-1 | GA-2 | GA-3 | GA-4 | Micro-GA |
|---|---|---|---|---|---|
| Population size | 500 | 500 | 100 | 50 | 5 |
| Probability of jump mutation ($p_{jump}$) | 0.1 | 0.01 | 0.01 | 0.02 | 0 |
| Creep mutation probability ($P_{creep}$) | 0 | 0 | 0.02 | 0.04 | 0 |
| Number of generations | 585 | 41 | 48 | 51 | 389 |
| Objective function value | −0.00853 | 0 | 0 | 0 | 0 |
| Number of objective function evaluations | 292,000 | 20,500 | 4800 | 2550 | 1945 |

With a population size of 500 and a jump mutation probability of 0.1, there are almost 300,000 function evaluations before the best solutions almost meet the design goals. Decreasing the jump mutation probability to 0.01 results in an order of magnitude reduction in the number of objective function evaluations, and the best solutions of this GA run meet all the specified design goals. Population sizes of 100 and 50 with probability of jump mutation $p_{jump}=1/N_{pop}$ and probability of creep mutation $p_{creep}=2p_{jump}$ require even fewer evaluations to reach desired solutions.

Figure 13:
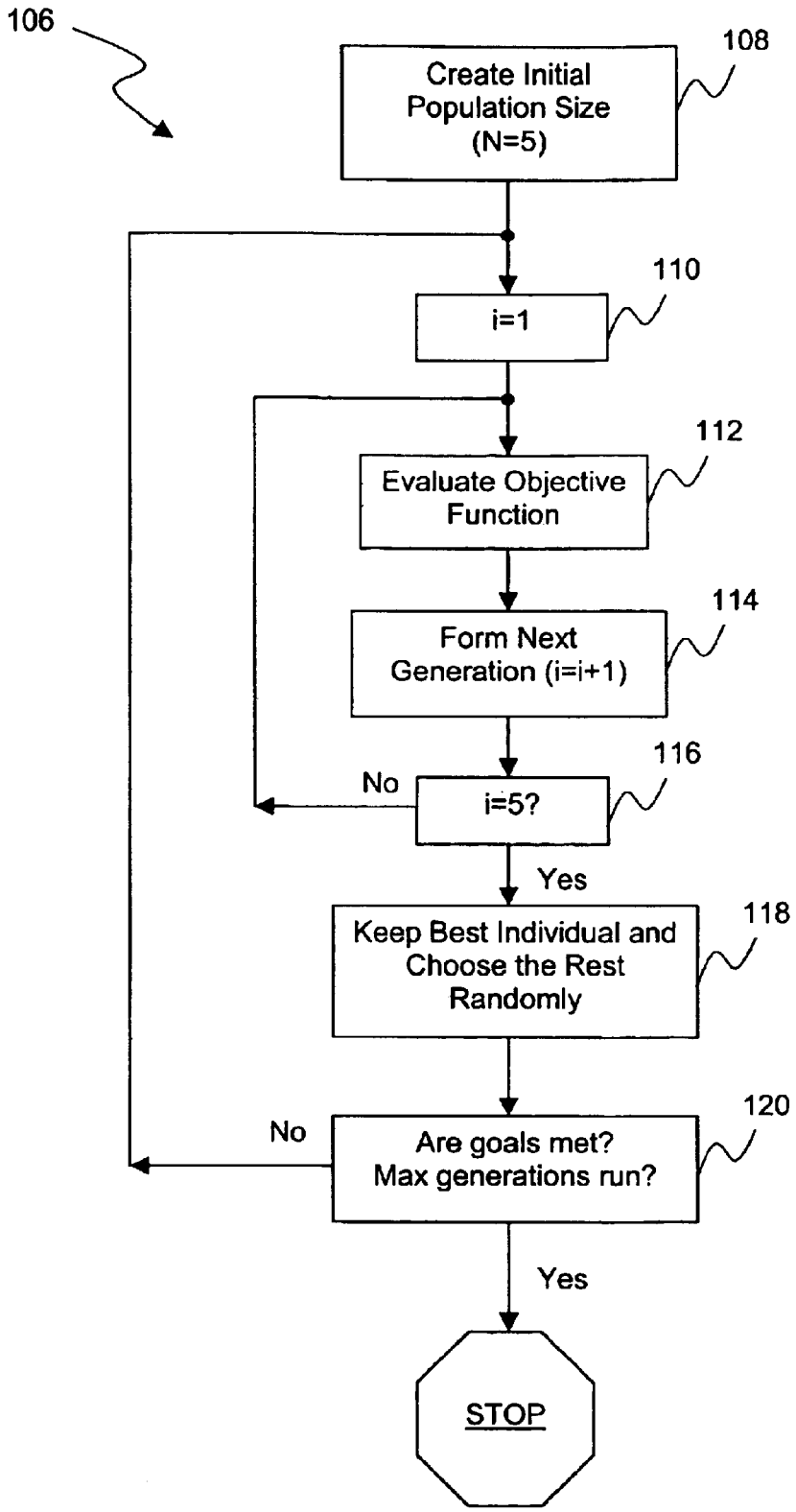
FIG. 13 displays a block diagram representing exemplary steps in a micro-GA process optimization algorithm in accordance with the present subject matter.

In this case, the micro-GA is demonstrably the most efficient and convenient choice per the present subject matter for the optimization of the loaded antenna. FIG. 13 displays a block diagram representing exemplary steps in a micro-GA process 106 in accordance with the present subject matter. The micro-GA optimization process starts by creating an initial population of small size in step 108. In this particular example, there are only five members in each population and a mutation operator is not used. In a first iteration (after setting i=1 in step 110), the objective function is evaluated in step 112 for each member of the population. The next generation is formed in step 114 with crossover and elitism, and five generations are developed by a loop check established at step 116. Upon every fifth generation, step 118 then corresponds to the best member of the previous generation being kept along with several others, four in this case, selected at random. The iteration then successively repeats itself until the design criteria are met (as checked in step 120.) The micro-GA's ability to rapidly find desired solutions with small population sizes can be attributed to its use of the elitism operator in keeping the best member in a population.

The varied GA and integral solution techniques referenced above may be utilized per the present subject matter to design component values for loaded antenna configurations. There are several ways in which the antenna configurations can potentially be constructed. The construction of several embodiments of loaded antenna and matching network configurations are hereafter presented in the context of particular methods and material specifications, and are presented with particular reference to a loaded monopole antenna. It should be readily appreciated by those of ordinary skill in the art that the construction and realization of the monopole antenna could be easily applied to other configurations. For instance, a dipole antenna embodiment could be constructed using similar load values and positions. As would be understood, the matching network may need adjusting in such circumstances. This is due to the fact that the monopole impedance is half that of the dipole. Thus, the values of the components in the matching network as hereafter specified for a monopole would need to be doubled for the construction of a monopole.

A first exemplary embodiment per present subject matter of a broadband monopole antenna preferably comprises an antenna with a single load circuit, such as antenna configuration 10 in FIG. 1*a*. The load circuit 12 could be any of the load circuits illustrated in FIG. 3, but a simple exemplary load circuit would comprise a parallel coil and resistor such as that in FIG. 3*c*. The coil may be formed for example by winding five turns of "20 AWG" wire of 0.813 mm diameter on a ½–13 nylon all-thread rod, providing a coil whose diameter is 12.7 mm with 5.12 turns per cm. The coil may then be removed from the all-thread rod before incorporation with the antenna structure. The approximate inductance of such a coil is approximately 0.22 $\mu$H. A quarter-Watt 470Ω resistor may be placed in the axis of the coil and soldered across its terminals to create a parallel RL load circuit.

The portion of antenna 26 between the feed and the coil and spanned by distance 20 may be the protruding center conductor of a 141 mil (3.58 mm diameter) semi-rigid coaxial cable. This cable is the feedline for the antenna and attaches to a transmission line or other device behind ground reference plane 16. The antenna section 18 above the coil is preferably a straight wire (20 AWG). Such a wire size is preferably utilized since its diameter 22 of 0.813 mm is close to the 0.912 mm diameter if the 141 mil coax center conductor. The 50Ω semi-rigid coaxial feedline enables one to measure the input impedance of the antenna without a matching network present. When a matching network is present in such an antenna configuration, the portion of the antenna below the load circuit 12 can be replaced with 20 AWG wire which extends through a hole with a diameter 24 of 0.4 cm. This wire is attached directly to a matching network 14 behind the ground plane 16. The 141 mil coaxial feedline is not necessary when a matching network is present.

A second exemplary embodiment of the present subject matter may comprise a monopole antenna 30 tuned with three loads 32, 34, and 36 and fed through a matching network 38, as represented by the exemplary antenna configuration of FIG. 1*b*. Although the three load circuits 32, 34, and 36 along the antenna 48 could comprise any of the exemplary load circuits presented in FIG. 3, a simplified embodiment for purposes of discussion utilizes the parallel RL circuit of FIG. 3*c* for loads 32 and 34 and the single inductor circuit of FIG. 3*d* for load 36. Elimination of the resistive element of the first load 36 does little to change the antenna performance.

The diameter 46 of the antenna arm 48 may be calculated from an ideal frequency range of antenna operation. As an example, for an ideal frequency range of operation from 100–2000 MHz, an antenna diameter 46 of 0.635 cm may be used. Brass thin-wall tubing is readily available and in this size and thus an antenna arm is easily constructed from such material.

For such antenna diameter, a corresponding antenna height of 42.5 cm is used. The coils used for constructing the inductors for load circuits 32 and 34 may be constructed by winding 20 AWG wire on standard all-thread dielectrics rods. Such dielectric rods may typically be nylon or teflon of sizes (0.25; 20) or (0.5;13), where a size of (x;y) corresponds to an x-inch diameter and y threads per inch. The rods may then be removed from the coil configuration in order to eliminate dielectric effects caused by the rods. Standard quarter-Watt resistors may be used for the resistor portions of the load circuits. The resistor may then be configured such that it is parallel to the coil, and may be placed either inside or outside the winding to form the parallel LR load. Exemplary specifications for the load circuits as discussed for this second embodiment are presented in the following table, Table 4. Specifications are presented for two exemplary variations of third load 32.

TABLE 4

| Specifications for exemplary load circuits (42.5 cm antenna) | | | | |
|---|---|---|---|---|
| | Load 1 (36) | Load 2 (34) | Load 3a (32) | Load 3b (32) |
| Position (cm) | 2.9 | 9.6 | 32.5 | 32.5 |
| # turns | 1.5 | 3 | 10 | 3 |
| Winding form | ¼–20 | ¼–20 | ½–13 | ¼ |
| Core material | Air | Air | Air | Ferrite #61 |
| Wire gauge (AWG) | 20 | 20 | 20 | 20 |
| Wire radius (mm) | 0.4 | 0.4 | 0.4 | 0.4 |
| Wire spacing (mm) | 1.3 | 1.3 | 2.0 | 1.3 |
| Coil radius (cm) | 0.3 | 0.3 | 0.63 | 0.36 |
| Gap width (cm) | 0.35 | 0.85 | 2.4 | 1.0 |
| Resistance (Ω) | N/A | 1200 | 470 | 470 |
| Inductance (μH) | 0.01 | 0.038 | 0.56 | 0.53 |

As mentioned, general dimensions for a loaded antenna configuration depend on the desired frequency range of antenna operation, as determined by one practicing the present subject matter. Consider a lowest frequency of operation of about 50 MHz as opposed to the lowest frequency of about 100 MHz desired in the second exemplary antenna embodiment. Such an antenna may be constructed using standard size 1.27 cm diameter brass thin-wall tubing of about 106.25 cm in length. Exemplary specifications for the load circuits for such an antenna are presented in the following Table 5.

TABLE 5

| Specifications for exemplary load circuits (106.25 cm antenna) | | | |
|---|---|---|---|
| | Load 1 (36) | Load 2 (34) | Load 3 (32) |
| Position (cm) | 3.26 | 22.8 | 80.1 |
| # turns | 1.5 | 5 | 7 |
| Winding form | ¼–20 | ¼–20 | 1.19 cm diameter |
| Core material | Nylon | Nylon | Ferrite #61 |
| Wire gauge (AWG) | 20 | 20 | 20 |
| Wire radius (mm) | 0.4 | 0.4 | 0.4 |
| Wire spacing (mm) | 1.3 | 1.3 | 1.4 |
| Coil radius (cm) | 0.3 | 0.3 | 0.64 |
| Gap width (cm) | 0.5 | 1.2 | 1.1 |
| Resistance (Ω) | N/A | 1300 | 680 |
| Inductance (μH) | 0.027 | 0.11 | 1.1 |

The inclusion of a matching network with the presented exemplary loaded antenna embodiments is instrumental per the present subject matter in further increasing the bandwidth of the resulting system. Measurements suggest that a simplest form of matching network as displayed in FIG. 4*a* offers adequate improvement in bandwidth compared with more complicated matching networks. Thus, such exemplary matching network comprising a transmission-line transformer and a parallel inductor is discussed herein relative to particular methods of construction. Such a matching network 122 may be connected to an antenna 124 and transmission line 126 such as in FIG. 5*a*. In FIG. 5*a*, the characteristic impedance $Z_0$ of the transmission lines 126 may for example be around 50Ω. Transmission line transformers offer wider bandwidth and greater efficiency than conventional transformers and the principles of operation of such devices differ considerably from those of conventional transformers.

One example of a transmission line transformer suitable for use in accordance with exemplary matching network 122 of the subject antenna designs is a Guanella 1:4 unun (represented by 128). The impedance-matching-network device for a loaded monopole antenna must be implemented as a unun, instead of a balun, since it connects an unbalanced coaxial line to the monopole (which is an unbalanced load). Thus, one terminal of the load is held at ground potential. An inductor 130 may be provided in parallel across the transmission line transformer 128.

Such an impedance transformer for use in many transmission line matching network designs may be constructed of multifilar windings on ferrite toroidal cores. Such type of component material and construction typically works well from several MHz to about 100 MHz. It is hard to scale such a device for use in higher frequency bands, such as 200 MHz to 1 GHz. Thus it may be more practical to utilize alternative embodiments of the impedance transformer for use in a matching network-based embodiment.

A present exemplary alternative implementation of an impedance transformer, involving a beaded coaxial cable 132, is much simpler to construct. A schematic illustration of such an embodiment 134 is given in FIG. 5*b*, wherein the matching network is positioned relative to a ground plane 136 and connected to an antenna 138. Since coaxial cable 132 is used, there is no need to adjust the bifilar windings to achieve the desired characteristic impedance. In order to realize a 1:4 impedance transformation called for in the design process, a 50Ω line is matched to a 200Ω line. The optimal $Z_0$ for the transmission lines in this network is 100Ω, but the exemplary device herein is fabricated from 93Ω line (RG62A/U) since it is readily available. Such line is a flexible cable having a stranded, outer-conductor braid and a solid center conductor. A plastic jacket covers the outer-conductor braid and makes the diameter of the cable 0.6 cm. The jacket and outer conductor braid are preferably then stripped and replaced by copper conducting tape of thickness 0.5 mm. Such a resulting modified 93Ω cable has a diameter of 0.41 cm. Next, the inner conductors of two sections of this modified cable can be soldered to the center pin of a model 2052-0000-00 female-type SMA flange connector, such as that manufactured by MA/COM. These center conductors can be covered with pieces of dielectric and in turn covered with conducting tape. The conducting tape is soldered to the SMA connector flange. The length of the two coaxial sections may typically measure 7.5 cm from the flange surface to the end. Nine ferrite toroidal cores 140 of type FT-37-61 followed by nine of type FT-37-43 may then be placed around the outer conductor of one of the coaxial cables. Such cores may be cores manufactured by Amidon, Inc.

The constructed impedance transformer described above can be combined with an inductor, such as a 0.15 μH off-the-shelf inductor manufactured by Digi-key, part number DN2500-ND. This could be soldered across the terminals of the device in FIG. 5*b* to produce a matching network such as that represented in FIG. 4*a*. Other passive elements may be combined with this circuit to form matching network configurations such as those of FIGS. 4*b* and 4*c* as well as others.

Figure 7A:
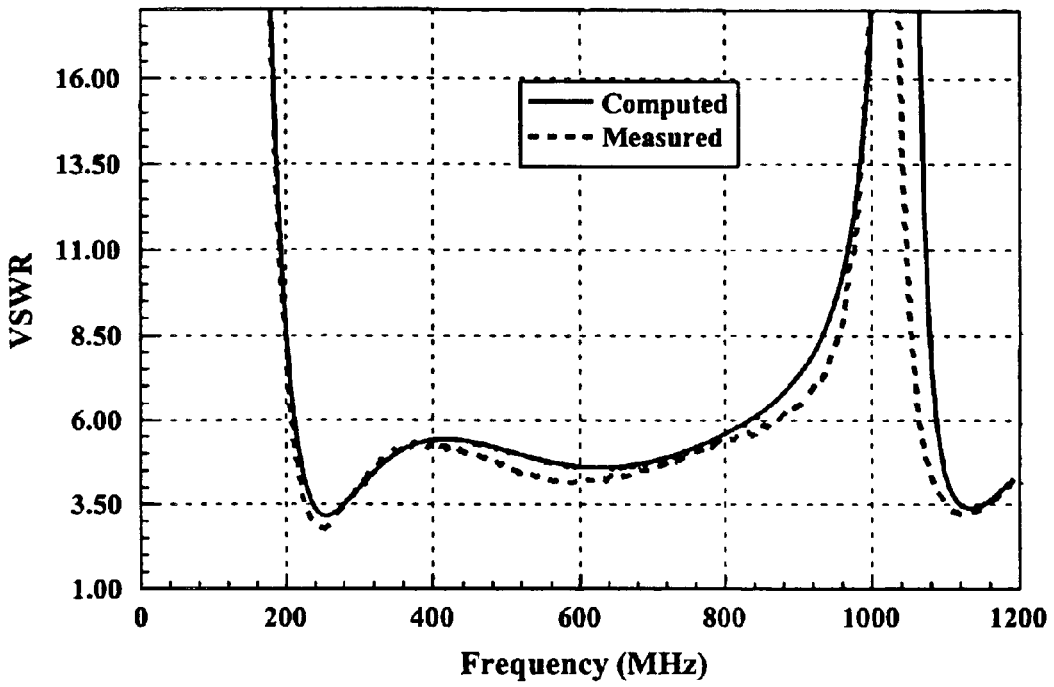
FIGS. 7*a* and 7*b* display measured data for a first exemplary embodiment in accordance with present subject matter with no matching network in accordance with the present specification.
Figure 7B:
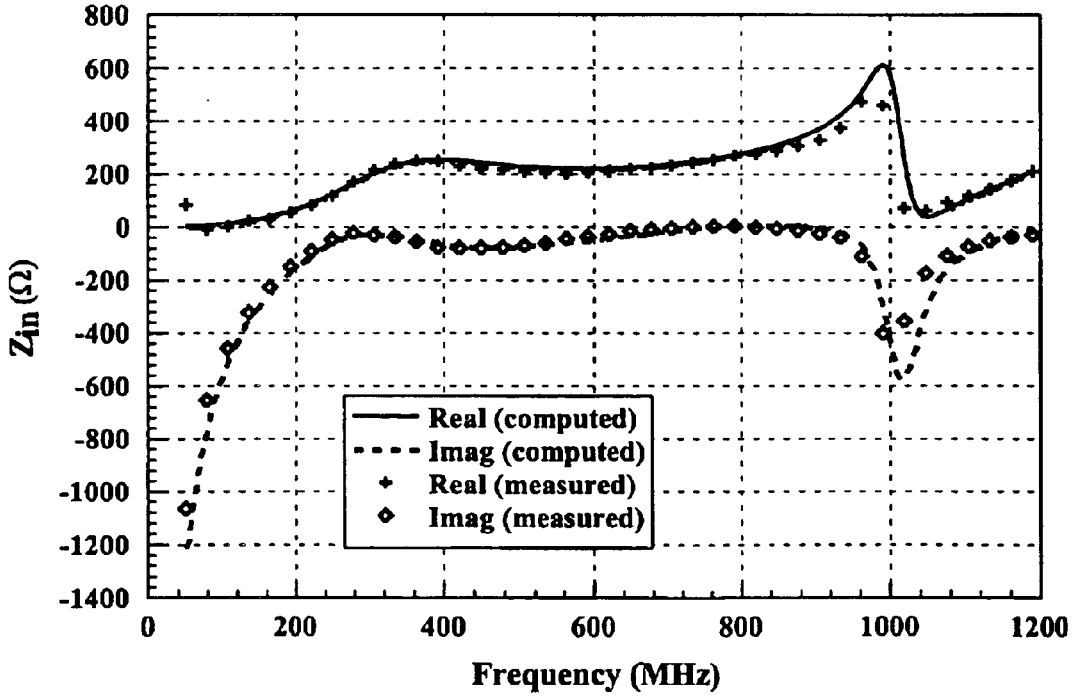

Measured results are available for the exemplary embodiments and parameters provided in the specification. Comparison of computed theoretical antenna performance and measured actual antenna performance is useful in evaluating the effectiveness of actual fabrications. The first exemplary embodiment as discussed in the specification with a single load circuit such as FIG. 1*a* but with no matching network was analyzed and the results are presented in FIGS. 7*a* and 7*b*. FIG. 7*a* presents measured versus computed voltage standing wave ratio (VSWR) for such first embodiment, and FIG. 7*b* presents measured versus computed input impedance. Good agreement is observed between the computed and measured data for the embodiment without the matching network.

Figure 5A:
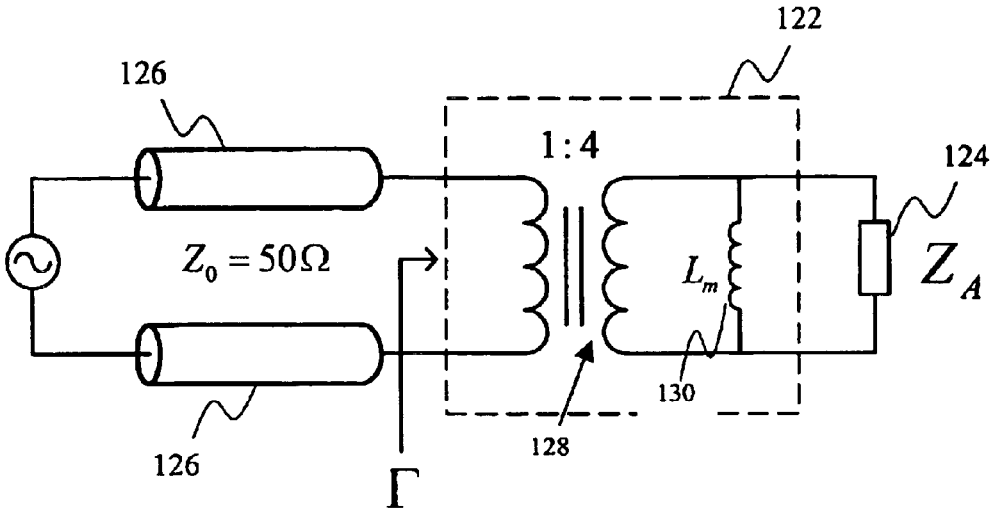
FIG. 5*a* is a schematic representation of an exemplary matching network for connection between exemplary transmission lines and an antenna load.
Figure 5B:
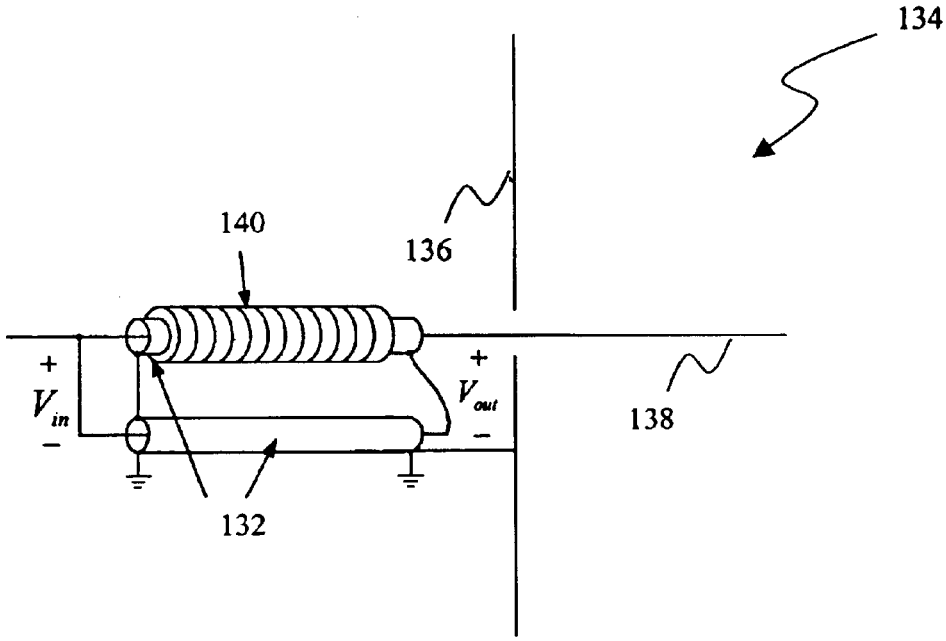
FIG. 5*b* illustrates an exemplary transmission line transformer for use in matching networks in accordance with present subject matter.
Figure 8A:
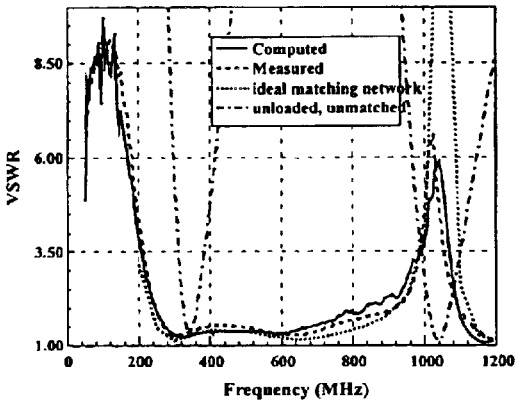
FIGS. 8*a*, 8*b*, 8*c* and 8*d* display measured data for the first exemplary embodiment as referenced in conjunction with present FIGS. 7*a* and 7*b*, with a first exemplary matching network in accordance with the present specification.
Figure 8B:
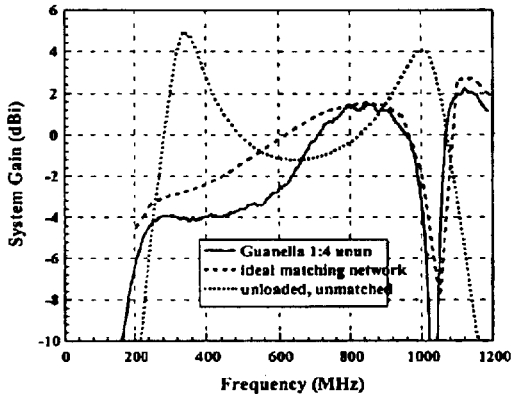
Figure 8C:
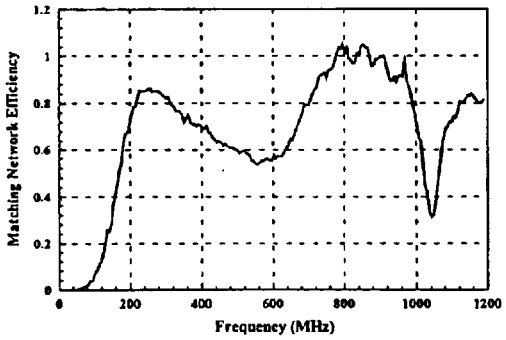
Figure 8D:
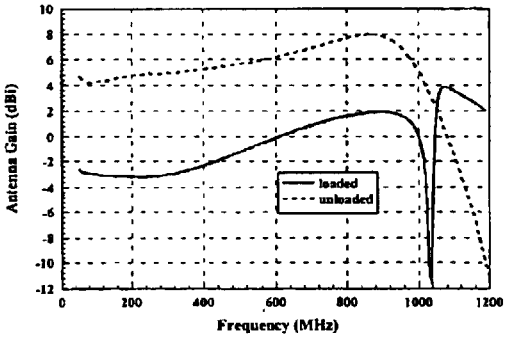

Data is also provided for the first embodiment with a matching network such as that illustrated in FIG. 5*b*. FIG. 8*a* illustrates the measured versus computed VSWR for such an antenna configuration with single LR load and matching network comprising an impedance transformer. From the data of FIG. 8*a*, it is seen that the VSWR is below 3.5 over a 5:1 bandwidth from 200–1000 MHz, though it is much lower than 3.5 over most of this band. An acceptable VSWR is of little value if the antenna does not radiate, so system gain is also of importance. FIG. 8*b* displays the computed system gain of the broadband monopole and matching network. The gain is greater than −4 dBi over the band 250–1000 MHz and is down to −6 dBi at 200 MHz. Since the constructed 1:4 Guanella unun of the matching network is not 100% efficient over such band, the system gain is lower than the system gain of this antenna with an ideal matching network. Also, for most frequencies in the band of interest, the system gain of the broadband antenna is less than that of a monopole antenna of the same height and wire radius. The antenna gain of the monopole loaded with the parallel LR circuit is as much as 8 dBi less than that of the unloaded antenna. Thus, a considerable improvement in VSWR typically comes at the expense of the amount of power radiated at the horizon relative to the transmitter power. FIG. 8*c* displays the computed network efficiency versus frequency of operation and FIG. 8*d* displays the computed antenna gain versus frequency of operation.

Figure 4A:
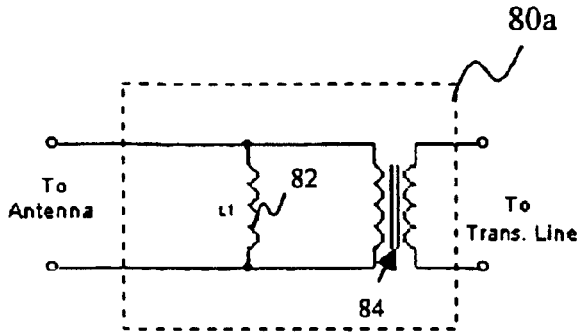
FIGS. 4*a*, 4*b* and 4*c* display exemplary matching networks for connecting an antenna through to a transmission line for use in antenna configurations in accordance with the present subject matter.
Figure 4B:
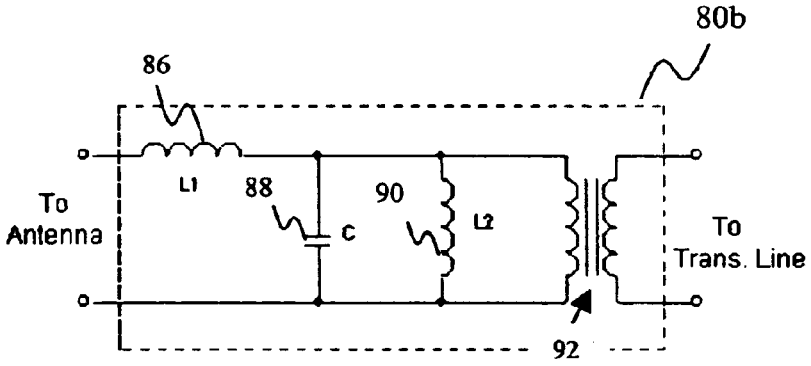
Figure 4C:
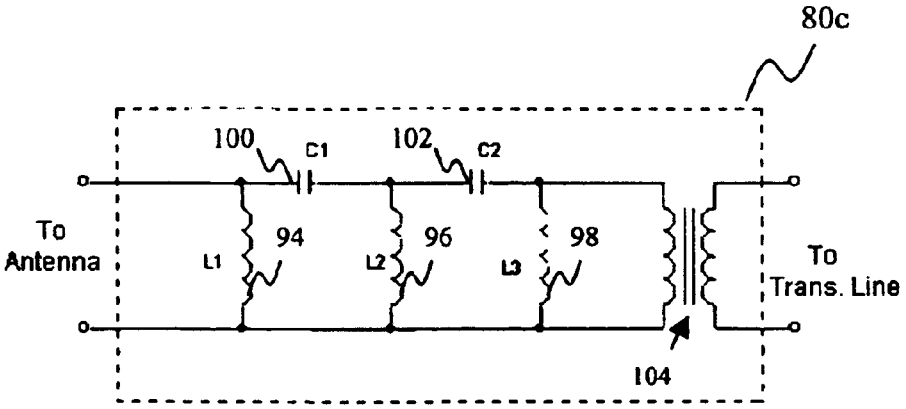
Figure 9A:
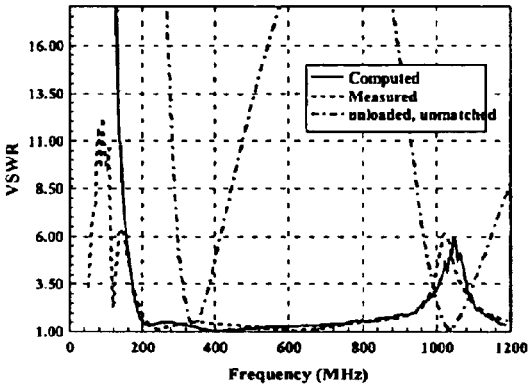
FIGS. 9*a*, 9*b* and 9*c* display measured data for a present second exemplary embodiment of the present subject matter with a second exemplary matching network in accordance with the present specification.
Figure 9B:
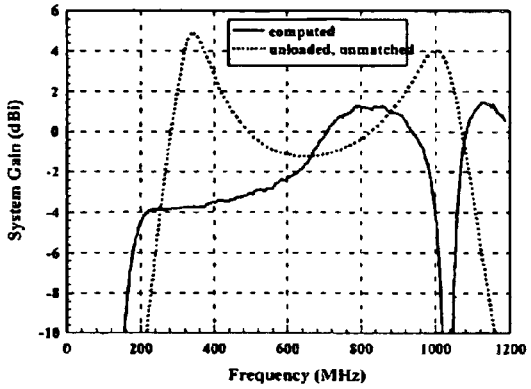
Figure 9C:
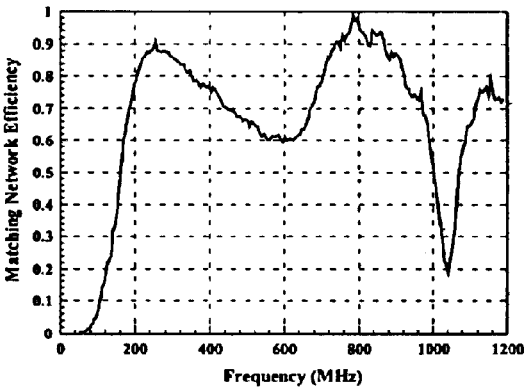

Data is also provided for an exemplary antenna configuration such as FIG. 1*a* with single LR load circuit and a matching network with an impedance transformer and parallel inductor such as the matching network of FIG. 4*a*. More specific parameters of this tested configuration are previously disclosed in the specification. FIG. 9*a* illustrates the VSWR of such antenna configuration; FIG. 9*b* displays the system gain thereof; and FIG. 9*c* shows the matching network efficiency. FIGS. 9*a*, 9*b* and 9*c* indicate that the performance of the loaded monopole is improved at the lower end of the frequency band with the inclusion of the parallel inductor in the matching network. The VSWR is well below 3.5 at 200 MHz after the inductor is added to the matching network. As a result, system gain is improved to around −4.3 dBi at 200 MHz. Compared to the broadband system and data of FIG. 8, the matching network efficiency is degraded around 1000 MHz when the inductor is added. System gain drops from about −2 dBi to −4dBi around 1000 MHz with the addition the inductor. S-parameters for the Guanella 1:4 unun with and without the inductor were analyzed and the most significant differences in characterization were at the lower portions of the band.

Specific parameters and characteristics were previously suggested in the specification in relation to a second exemplary embodiment of the present subject matter, such as that displayed in FIG. 1*b*. Several exemplary specific configurations of the elements in such second embodiment are presented in Tables 4 and 5. The loaded antenna configurations may also be combined with a matching network such as that also described in the specification and similar to that displayed in FIG. 5*b*. Additional elements may be combined with the structure of FIG. 5*b* to form alternative embodiments of the matching network. Results are now presented for the performance of various forms of such second exemplary embodiment with three load circuits.

Figure 10A:
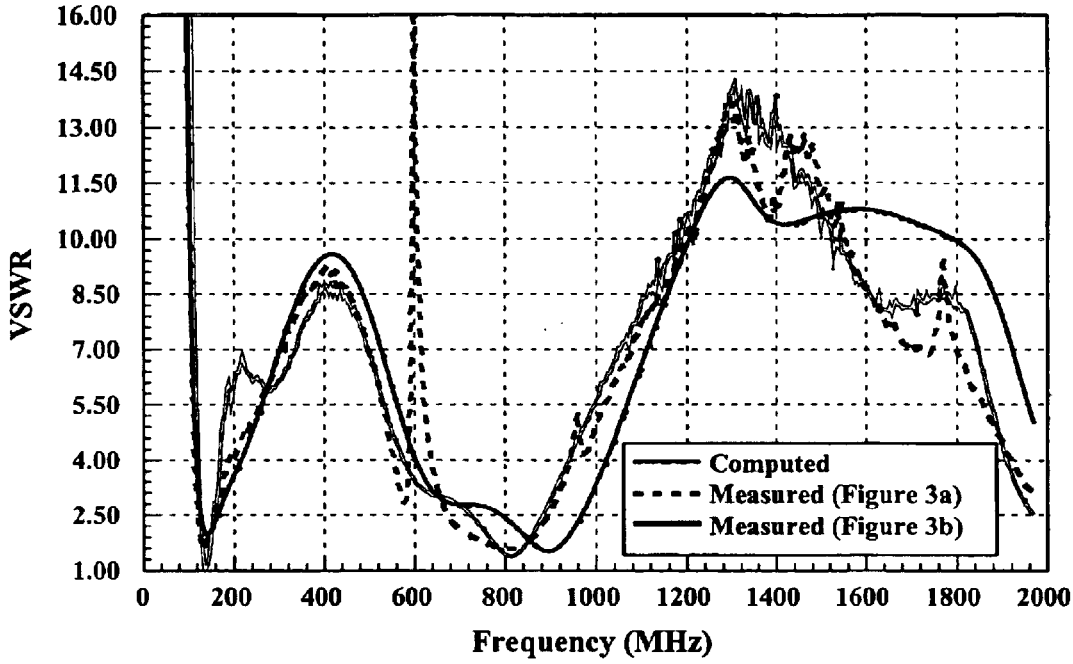
FIGS. 10*a* and 10*b* illustrate graphical data for a first exemplary variation of the present second exemplary embodiment of the present subject matter with no matching network employed in accordance with the present subject matter.
Figure 10B:
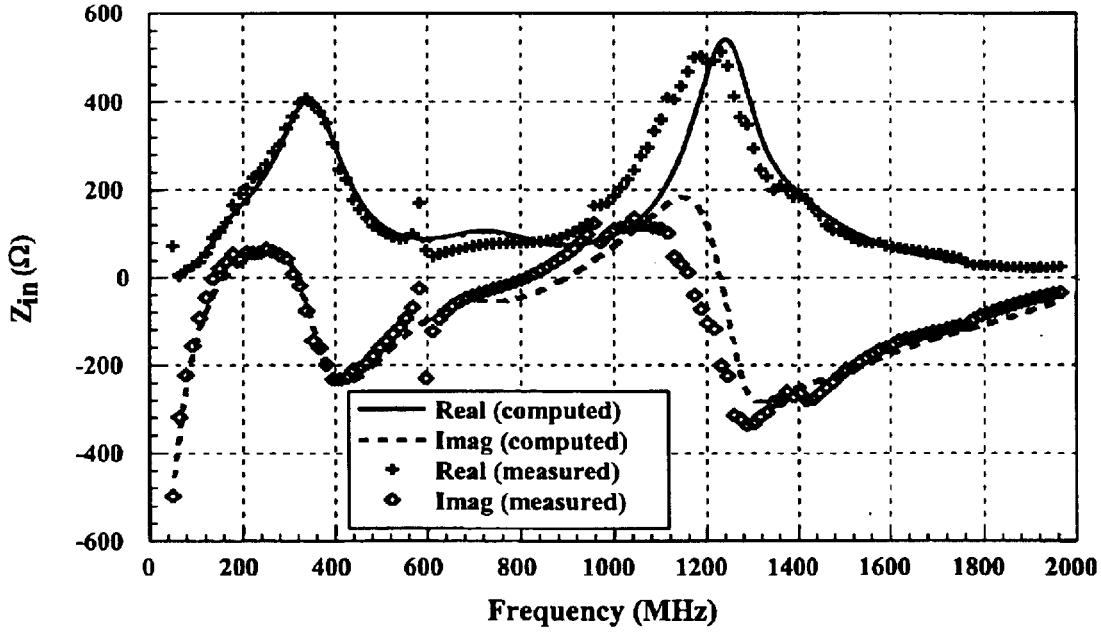

The input impedance and VSWR of a 42.5 cm antenna embodiment such as that specified by the parameters of Table 4, with Load 3*a* as opposed to 3*b*, and no matching network attached, are presented in FIGS. 10*a* and 10*b*, respectively. It is seen from FIG. 10*a* that there is good agreement in measured and computed VSWR values over the frequency band up to 1200 Mhz with the exception of a large narrowband spike in VSWR around 600 MHz. The spike is measured on the antenna having the ten-coil turn as its third load (Load 3*a* of Table 4), and is eliminated when the ten-turn coil is replaced by a three turn coil of approximately the same inductance (Load 3*b* of Table 4). The agreement of measured and computed VSWR is not as good above this 1200 MHZ frequency as it is below this frequency. The disagreement may be due to interwinding capacitance which is not included in the coil model.

Figure 11A:
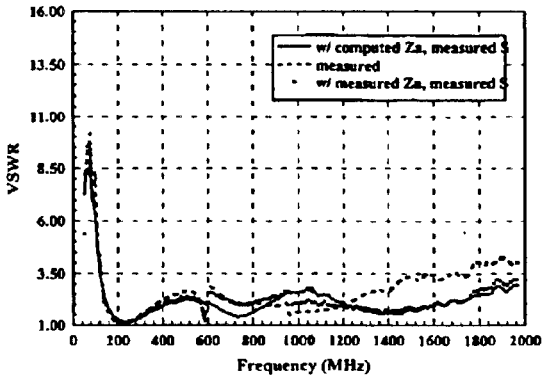
FIGS. 11*a*, 11*b*, 11*c* and 11*d* illustrate graphical data for such first exemplary variation of the second exemplary embodiment of the present subject matter with an exemplary matching network.
Figure 11B:
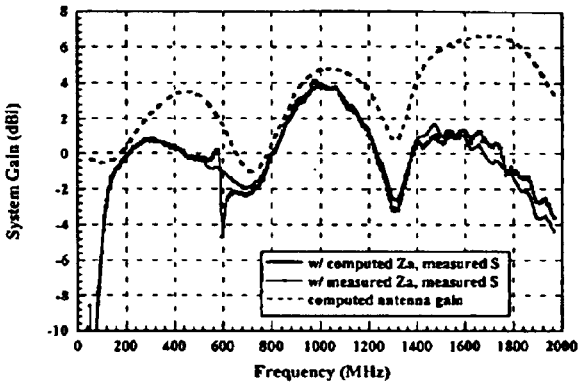
Figure 11C:
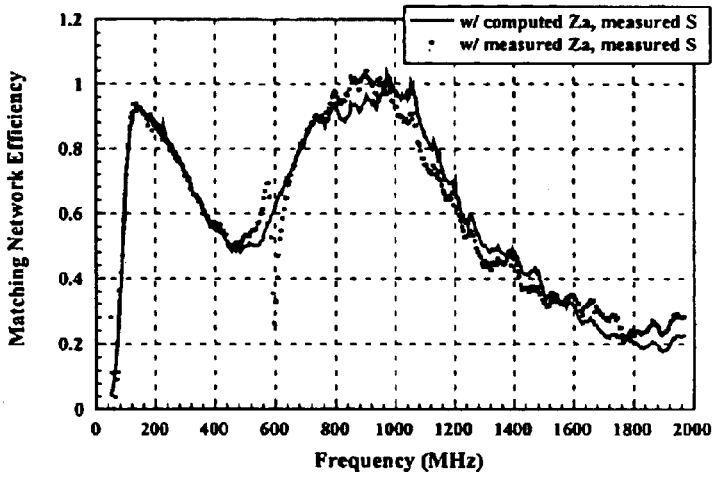
Figure 11D:
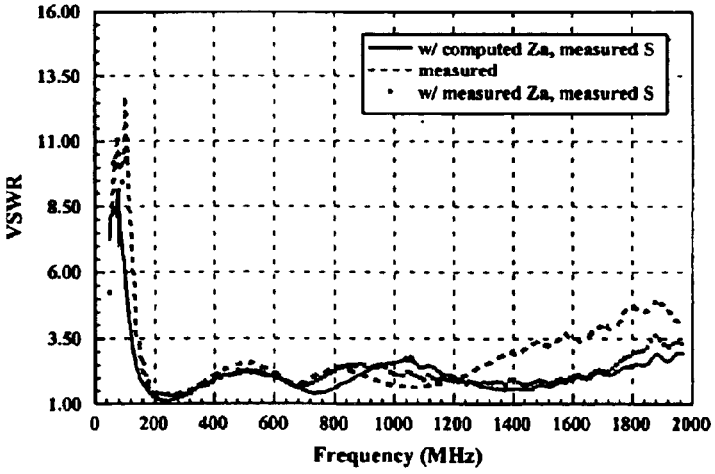

Measurements are also presented for the second exemplary antenna embodiment with matching network. FIGS. 11*a*, 11*b* and 11*c* display data corresponding to VSWR, system gain and matching network efficiency, respectively for such second loaded antenna embodiment with load 3*a* as opposed to 3*b* and a matching network such as that displayed in FIG. 5*b*. In the analysis, the matching network is treated as a two-port microwave circuit terminated by the antenna input impedance, and which may be either measured or computed. Data labeled "computed" were arrived at from measuring matching network s-parameters and antenna input impedance computed from integral equation solutions. Data labeled "measured" result from terminating the two-port model of the matching network connected to the antenna. The measured and computed values as seen in FIGS. 11*a*, 11*b* and 11*c* are obviously close as long as the input impedances agree. FIG. 11*c* illustrates the voltage standing wave ratio of the second embodiment with load 3*b* and a matching network such as that in FIG. 5*b*. It is seen that with the addition of the matching network, the VSWR of the antenna with load 3*b* is reduced significantly over a wide band. The VSWR is less than 3.5 and the system gain is greater than −4 dBi over the band 125–1575 MHz, a 12.6:1 bandwidth ratio. This is a conservative estimate of the bandwidth ratio since the measured VSWR is around 3.5 for frequencies up to 1750 MHz.

Figure 12A:
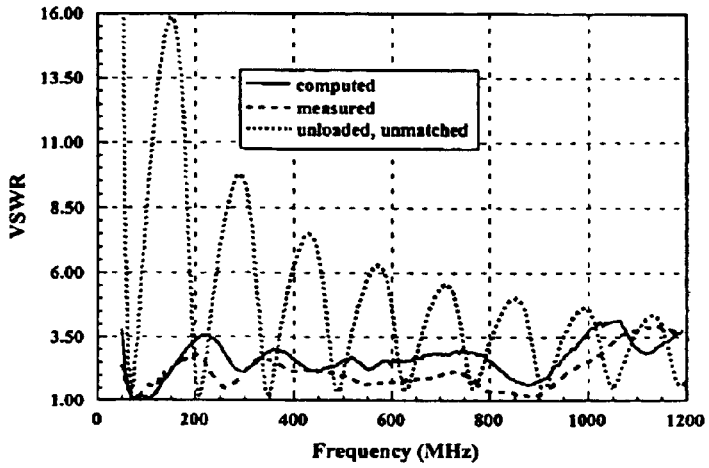
FIGS. 12*a*, 12*b* and 12*c* illustrate graphical data for a second exemplary variation of the second exemplary embodiment of the present subject matter with an exemplary matching network.
Figure 12B:
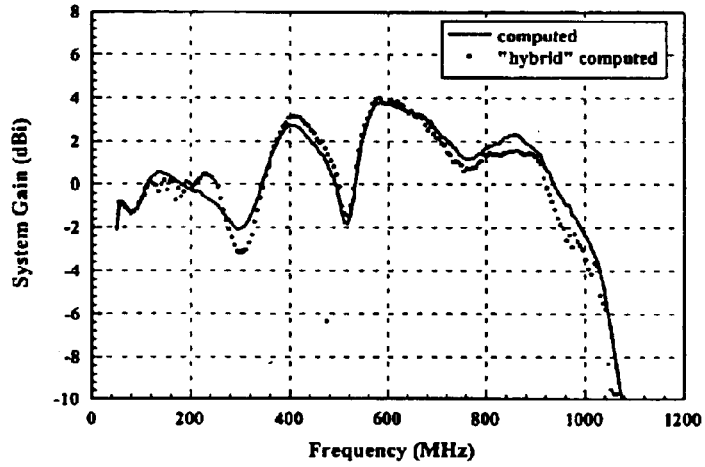
Figure 12C:
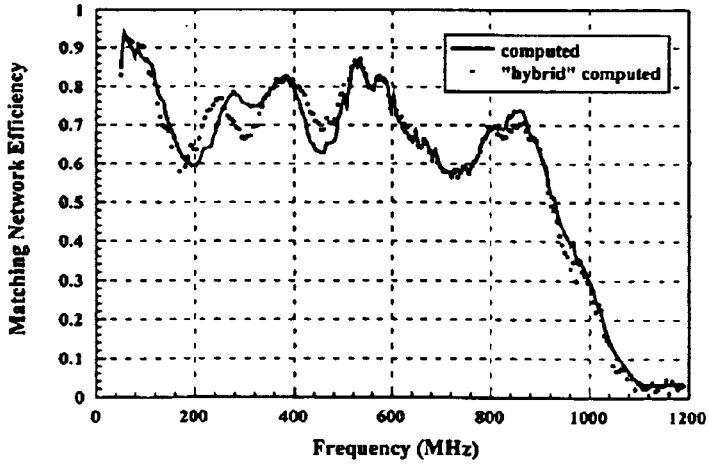

The second exemplary antenna embodiment is also presented by the specifications of Table 5, and a distinguishing feature of such embodiment is its increased height. This height increase further increases the bandwidth of the antenna embodiment. This is seen in the data provided in FIGS. 12*a*, 12*b* and 12*c* which display the VSWR, system gain and matching network efficiency, respectively. The effective bandwidth of this antenna over a frequency range from 50 MHz–1 GHz is 20:1. The system gain of the loaded and matched network is mimimum around 300, 500 and 1000 MHz, and it is significantly improved compared to the deep nulls in the system gain of an unloaded structure. At some frequencies, the unloaded antenna's system gain is better than that of the loaded antenna with matching network, so elimination of the system gain nulls at some frequencies may come at the expense of system gain performance at other frequencies.

Genetic algorithms and micro-GAs as well as other numerical techniques in accordance with the present subject matter may thus be readily applied for improving a loaded wire monopole antenna with parallel LR circuits and matching network. A much more accurate analysis may be obtained using curved wire modeling per the present subject matter as opposed to lumped load modeling of the load circuits. Ideal methods of constructing such loaded antenna configurations and exemplary matching networks are realized. Experimental measurements confirm that the constructed designs will indeed operate over a wider frequency range with low VSWR and with adequate system gain, per advantageous practice of the present subject matter. As referenced above, those of ordinary skill in the art will appreciate modifications and variations which may be practiced with and to the present subject matter, all of which are intended to come within the spirit and scope of the present disclosure.

What is claimed is:

1. A broadband antenna configured to operate in a substantially wide frequency band and to provide omnidirectional radiation in azimuth, said broadband antenna comprising:

at least one substantially straight antenna arm;

at least one load circuit including a combination of passive circuit elements positioned in a predetermined location along said at least one substantially straight antenna arm, wherein values for selected passive circuit elements and for the predetermined location of said at least one load circuit is optimized via an optimization algorithm; and a matching network provided at the base of said at least one substantially straight antenna arm for connecting said broadband antenna to a transmission line, said matching network comprising a transmission line transformer in parallel with an inductor; and wherein the optimization algorithm employed to design values of selected passive components and the location of said at least one load circuit utilizes curved-wire component modeling.

2. A broadband antenna as in claim 1, wherein said at least one load circuit comprises a resistor and an inductor provided in parallel.

3. A broadband antenna as in claim 1, wherein said transmission line transformer comprises a Guanella unun.

4. A broadband antenna as in claim 1, wherein said broadband antenna comprises two substantially straight antenna arms positioned such that said broadband antenna functions as a dipole antenna.

5. A broadband antenna as in claim 1, wherein said broadband antenna comprises three load circuits including a combination of passive circuit elements positioned in a predetermined location along said at least one substantially straight antenna arm, wherein values for selected passive circuit elements and for the predetermined location of each load circuit is optimized via an optimization algorithm.

6. A broadband antenna as in claim 5, wherein the optimization algorithm employed to design values of selected passive components and the location of each load circuit utilizes curved-wire component modeling.

7. A broadband antenna as in claim 5, wherein selected of said three load circuits comprise a resistor and an inductor provided in parallel.

8. A broadband antenna as in claim 5, wherein said transmission line transformer comprises a Guanella unun.

9. A broadband antenna as in claim 1, wherein two of said load circuits comprise a resistor and an inductor in parallel and one of said load circuits comprises an inductor.

10. A method of designing a loaded broadband antenna configuration with circuit values and locations for load circuits and a matching network positioned along such an antenna, said method utilizing a micro-GA technique and comprising the followings steps:

(i) establishing a set of design criteria for selected circuit values, load positions and antenna performance criteria;

(ii) creating an initial antenna population with member size N;

(iii) evaluating an objective function at least once for each member in the antenna population;

(iv) forming a selected number of successive generations of antennas, wherein said third step of evaluating an objective function is repeated for each generated antenna, and wherein said generating step is repeated for the selected number of times;

(v) choosing an elite generation of antennas by selecting the best member of the generated antenna population, said best member defined by selected results of said evaluating step, as well as by randomly selecting M other members to be included in the next generation of antennas; and (vi) determining if the established set of design criteria is met and subsequently either upon determining that the set of design criteria is met then ending said method, or upon determining that the set of design criteria is not met then repeating said method beginning at step (iii).

11. A method of designing a loaded broadband antenna configuration as in claim 10, wherein the set of design criteria corresponds to least one characteristic selected from the group consisting of a minimum value, maximum value, number of possible combinations and resolution.

12. A method of designing a loaded broadband antenna as in claim 10, wherein the antenna performance criteria comprise bandwidth, efficiency, gain, and voltage standing wave ratio (VSWR).

13. A method of designing a loaded broadband antenna as in claim 10, wherein the load circuit components and corresponding circuit values are selected from the group of passive components comprising resistors, capacitors and inductors.

14. A method of designing a loaded broadband antenna as in claim 10, wherein the micro-GA techniques are defined by at least one parameter and corresponding established value selected from the group consisting of elitism, niching, uniform crossover probability, jump mutation probability, and number of children per pair of parents.

15. A method of designing a loaded broadband antenna as in claim 10, wherein the initial antenna population has a member size of N=5.

16. A method of designing a loaded broadband antenna as in claim 10, wherein the objective function evaluated in step (iii) corresponds to $$F = -\sum_{i=1}^{N^f} \{u(VSWR(f_i), VSWR^D(f_i)) + u(G_{sys}^D(f_i), G_{sys}(f_i))\}$$

$$\text{where } u(x, y) = \begin{cases} |x-y|^2, x > y \\ 0, \text{otherwise} \end{cases},$$

where $G_{sys}=10\log_{10}\{(1-|\Gamma|^2)M_{eff}\ G_A(\theta=90°)\}$dBi, where $\Gamma$ is the reflection coefficient at the input to the matching network system, $M_{eff}$ is the matching network efficiency, $G_A$ is the antenna gain, the desired VSWR is denoted $VSWR^D$ and the minimum desired system gain is $$G_{sys}^D.$$

17. A method of designing a loaded broadband antenna as in claim 10, wherein M is an integer value less than or equal to N.

18. A method of designing a loaded broadband antenna as in claim 10, wherein said step of determining if the established set of design criteria is met further involves subsequently determining whether or not a predefined number of maximum iterations of said method has been reached, and if so then ending said method.

19. A method of designing a loaded broadband antenna as in claim 10, wherein said step of evaluating the objective function for each antenna member utilizes a single computed and inverted method of moments matrix corresponding to characterization of an unloaded antenna design and also subsequently utilizes a fast analysis technique to evaluate different load circuit configurations.

20. A method of designing a loaded broadband antenna as in claim 10, wherein coiled circuit elements in the load circuits of the loaded broadband antenna are represented using curved wire modeling techniques in said evaluating step.

21. A loaded broadband antenna configured to operate in a generally wide frequency band and to provide substantially omnidirectional radiation in azimuth, said loaded broadband antenna comprising:

a first substantially straight antenna arm portion defined by first and second respective ends thereof, a load circuit connected to a selected end of said first antenna arm portion, said load circuit comprising a resistor and a first inductor provided in parallel;

a second substantially straight antenna arm portion defined by a first end connected to said load circuit and a second end; and a matching network configured to interface the second end of said second antenna arm portion to a transmission line and to match the impedance of the loaded broadband antenna to the impedance of the transmission line, wherein said matching network comprises a transmission line transformer provided in parallel with a second inductor; and wherein the lengths of said first and second antenna arm portions are optimally designed via an optimization algorithm featuring curved wire modeling techniques for said first inductor.

22. A loaded broadband antenna as in claim 21, wherein said first inductor is rated at about 0.22 $\mu$H and said resistor is rated at about 470 Ω.

23. A loaded broadband antenna as in claim 22, wherein said first inductor is formed by a coil with about five turns, wherein the coil has a diameter of about 13 mm and a winding characteristic of 5.12 turns per cm.

24. A loaded broadband antenna as in claim 23, wherein said resistor is positioned within the axis of the coils of said first inductor and soldered across the terminals to create a parallel resistor-inductor load circuit.

25. A loaded broadband antenna as in claim 21, wherein selected of said first and second antenna arm portions are formed of 20 AWG straight wire.

26. A loaded broadband antenna as in claim 21, wherein said transmission line transformer comprises a Guanella 1:4 unun in parallel with an inductance of about 0.15 $\mu$H.

27. A loaded broadband antenna as in claim 21, wherein said antenna achieves a voltage standing wave ratio (VSWR) of less than 3.0 and a system gain greater than −3.2 dBi over a 20:1 ratio frequency band.

28. A loaded broadband antenna configured to operate in a generally wide frequency band and to provide substantially omnidirectional radiation in azimuth, said loaded broadband antenna comprising:

at least one substantially straight antenna arm, wherein said antenna arm is configured to provide a plurality of load circuits integrated at selected locations along said antenna arm, said antenna arm defined by first and second respective ends thereof, the first end being connected to a transmission line and the second end extending from the transmission line;

first, second and third load circuits provided at selected locations along said at least one substantially straight antenna arm, wherein selected of said load circuits comprise a resistor and a load inductor provided in parallel; and a matching network configured to interface the first end of said antenna arm to a transmission line and to match the impedance of the loaded broadband antenna to the impedance of the transmission line, wherein said matching network comprises a transmission line transformer provided in parallel with a matching network inductor; and wherein said loaded broadband antenna is adapted for operation in a frequency range from about 200 MHz to about 1 GHz; and wherein the circuit component values for each load circuit and the position of each load circuit along said antenna arm are optimally designed via an optimization algorithm featuring curved wire modeling techniques for each inductor.

29. A loaded broadband antenna as in claim 28, wherein said first load circuit and said second load circuit are positioned closer to the second end of said antenna arm than said third load circuit, wherein said first and second load circuits comprise a resistor and load inductor provided in parallel and wherein said third load circuit comprises a load inductor.

30. A loaded broadband antenna as in claim 29, wherein said transmission line transformer comprises a Guanella 1:4 unun in parallel with an inductance of about 0.15 $\mu$H.

31. A loaded broadband antenna as in claim 29, wherein selected portions of said antenna arm are formed of thin-walled brass tubing.

32. A loaded broadband antenna as in claim 29, wherein said antenna is about 43 cm long, the position of said first load circuit is about 10 cm from the second end of said antenna arm, the position of said second load circuit is about 33 cm from the second end of said antenna arm, and the position of said third load circuit is about 40 cm from the second end of said antenna arm.

33. A loaded broadband antenna as in claim 29, wherein said first load circuit comprises a resistor with a value of about 470 Ω and an inductor with a value of about 0.55 μH, wherein said second load circuit comprises as resistor with a value of about 1200Ω and an inductor with a value of about 0.04 μH, and wherein said third load circuit comprises an inductor with a value of about 0.01 μH.

34. A loaded broadband antenna as in claim 29, wherein said antenna is about 106 cm long, the position of said first load circuit is about 26 cm from the second end of said antenna arm, the position of said second load circuit is about 83 cm from the second end of said antenna arm, and the position of said third load circuit is about 103 cm from the second end of said antenna arm.

35. A loaded broadband antenna as in claim 29, wherein the load inductor of said first load circuit comprises winded coils on a ferrite core.

36. A loaded broadband antenna as in claim 29, wherein said first load circuit comprises a resistor with a value of about 680Ω and an inductor with a value of about 1.1 μH, wherein said second load circuit comprises a resistor with a value of about 1300Ω and an inductor with a value of about 0.11 μH, and wherein said third load circuit comprises an inductor with a value of about 0.027 μH.

37. A loaded broadband antenna as in claim 28, wherein selected of said load inductors comprise winded coils on a ferrite core.

* * * * *